US007992648B2

(12) United States Patent
Groonwald

(10) Patent No.: US 7,992,648 B2
(45) Date of Patent: Aug. 9, 2011

(54) LIGHT ULTRA HIGH PRESSURE FIRE VEHICLE SYSTEM

(75) Inventor: Rory L. Groonwald, Janesville, WI (US)

(73) Assignee: Orbital Technologies Corporation, Madison, WI (US)

( * ) Notice: Subject to any disclaimer, the term of this patent is extended or adjusted under 35 U.S.C. 154(b) by 258 days.

(21) Appl. No.: 12/428,298

(22) Filed: Apr. 22, 2009

(65) Prior Publication Data

US 2010/0270041 A1 Oct. 28, 2010

(51) Int. Cl.
*A62C 25/00* (2006.01)

(52) U.S. Cl. ..... 169/52; 239/172

(58) Field of Classification Search ..... 169/52, 169/24, 67; 239/195, 197, 198, 146
See application file for complete search history.

(56) References Cited

U.S. PATENT DOCUMENTS

| | | | | |
|---|---|---|---|---|
| 2,533,772 | A * | 12/1950 | De Frees | 280/4 |
| 4,278,132 | A * | 7/1981 | Hostetter | 169/13 |
| 4,345,654 | A * | 8/1982 | Carr | 169/24 |
| 4,446,591 | A * | 5/1984 | Wiedemann | 15/315 |
| 4,917,193 | A * | 4/1990 | Ockler | 169/24 |
| 5,054,545 | A | 10/1991 | Ghaemian | |
| 6,289,995 | B1 | 9/2001 | Fuller | |
| 6,340,177 | B1 * | 1/2002 | Granderson et al. | 280/833 |
| 2006/0254291 | A1 | 11/2006 | Allen et al. | |
| 2007/0173987 | A1 | 7/2007 | Rowe et al. | |
| 2009/0008105 | A1 | 1/2009 | Price et al. | |

FOREIGN PATENT DOCUMENTS

| | | | |
|---|---|---|---|
| DE | 3813419 | A1 * | 11/1989 |
| JP | 11-313902 | A | 11/1999 |
| JP | 2001-087408 | A | 4/2001 |
| JP | 2007-503880 | A | 3/2007 |

OTHER PUBLICATIONS

"Foam Firefighting Systems featuring CAT PUMPS", Cat Pumps company pamphlet, 2pp, downloaded Aug. 1, 2008.
"The History of FOGTEC Water Mist", http://www.fogtec-international.com/static/fogtec/en/water_mist/History/downloaded Jul. 15, 2008.
FOGTEC Mobile Systems, company pamphlet, 4 pp.
International Search Report for PCT/US2009/062158.
Written Opinion of the International Searching Authority for PCT/US2009/062158.

* cited by examiner

*Primary Examiner* — Davis Hwu
(74) *Attorney, Agent, or Firm* — Stiennon & Stiennon

(57) ABSTRACT

A firefighting apparatus on a small all-terrain utility vehicle has a U-shaped water tank closely spaced from the driver's cab. A reel for a high-pressure hose is mounted in the U of the water tank. A high-pressure engine driven pump is connected to the reel and a high-pressure hose through a water management system, which directs water from the water tank to the pump, and from the pump to the hose. The pump has a pressure valve which sets the engine idle when the high-pressure water nozzle is closed. A pressure unloader valve recirculates water from the pump outlet to the pump inlet when the nozzle is closed. A check valve is used between the water tank and a point where water recirculates to the pump. A prefilter is connected between the check valve and the water tank.

3 Claims, 3 Drawing Sheets

LIGHT ULTRA HIGH PRESSURE FIRE VEHICLE SYSTEM

BACKGROUND OF THE INVENTION

The present invention relates to mobile firefighting vehicles, which utilize high-pressure water as a firefighting agent in general, and small lightweight all-terrain vehicles in particular.

The typical fire engine is a truck to which is mounted a water tank, a water pump and a fire hose. The typical fire engine is a large over the road truck which is used for fighting fires principally in urban settings. It has long been known that high-pressure water at 1,100 to 1,500 PSI produces a water fog which is very effective for fighting fires. The water fog greatly increases the firefighting capabilities of a given amount of water, and allows water to be used in fighting liquid hydrocarbon and electrical fires. The combination of a small relatively lowcost vehicle which can operate in rough terrain and which has a relatively large effective water supply which can fight all types of fires makes this type of vehicle a cost-effective solution for a wide range of uses from rapid first response to machine fire fighting to bush firefighting. However, firefighting equipment of this type which is well integrated with the vehicle as well as being highly reliable and easily repaired is needed.

SUMMARY OF THE INVENTION

The firefighting apparatus of this invention has a small all-terrain utility vehicle with a rear skid bed to which is mounted a U-shaped water tank closely spaced to the driver's cab, a high-pressure hose and a reel mounted in the U of the water tank. A high-pressure pump and pump engine are mounted behind the water tank to the skid bed. Also mounted to the skid bed is a water management system, which directs low-pressure water from the water tank through an 80 mesh prefilter along a low-pressure supply pipe to the high-pressure water pump. The high-pressure water pump has a pressure valve which sets the engine idle when the high-pressure water nozzle is closed. The output of the high-pressure water pump flows to a high-pressure manifold. The high-pressure manifold has a high-pressure hose connected to a ball valve which in turn is connected to the water tank. The ball valve is mounted to a control panel and during starting of, the high-pressure pump the ball valve is open to return water to the water tank. The high-pressure manifold connects to a pressure unloader valve which supplies is water from the high-pressure manifold to the hose reel when closed but when opened, because the hose nozzle is closed and the back pressure exceeds a set point, allows water from the high-pressure manifold to recirculate to the high-pressure pump inlet. A check valve in the low-pressure supply pipe prevents water from backing up through the low-pressure prefilter and into the water tank. When the hose nozzle is closed a pressure sensor valve is actuated to place the pump engine in idle. When the hose nozzle is open the engine returns to speed, and the unloader valve closes. A 1½ inch hose connection is mounted to the control panel. The hose connection can be used to take in water from a pumper truck, a fire hydrant, or water reservoir to the water tank or directly to the high-pressure pump. When not in use the hose connection is closed by a 2 inch ball valve.

It is an feature of the present invention to provide a low-cost easily maintained ultrahigh pressure firefighting skid unit mounted to an all-terrain vehicle.

It is a further feature of the present invention to provide a highly maintainable water manifold for the ultrahigh pressure firefighting skid unit.

It is another feature of the present invention to provide an easily operated simple control system for a ultrahigh pressure firefighting skid unit.

It is another feature of the present invention to provide a low idle power usage system ultrahigh pressure firefighting skid unit.

Further features and advantages of the invention will be apparent from the following detailed description when taken in conjunction with the accompanying drawings.

DESCRIPTION OF THE PREFERRED EMBODIMENTS

Figure 1:
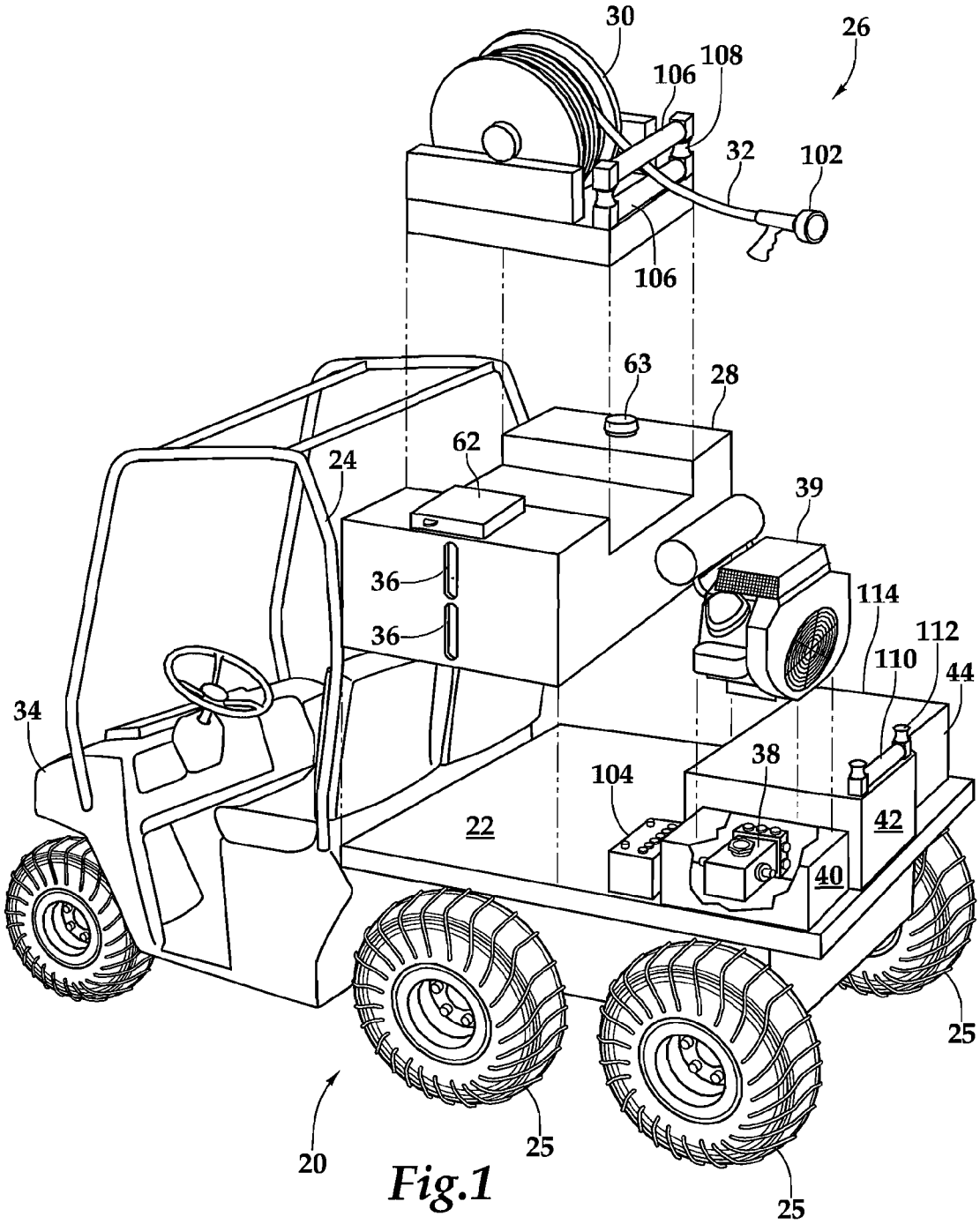
FIG. 1 is a schematic exploded isometric view of an all-terrain vehicle, with the ultrahigh pressure firefighting skid unit which mounts thereto.
Figure 2:
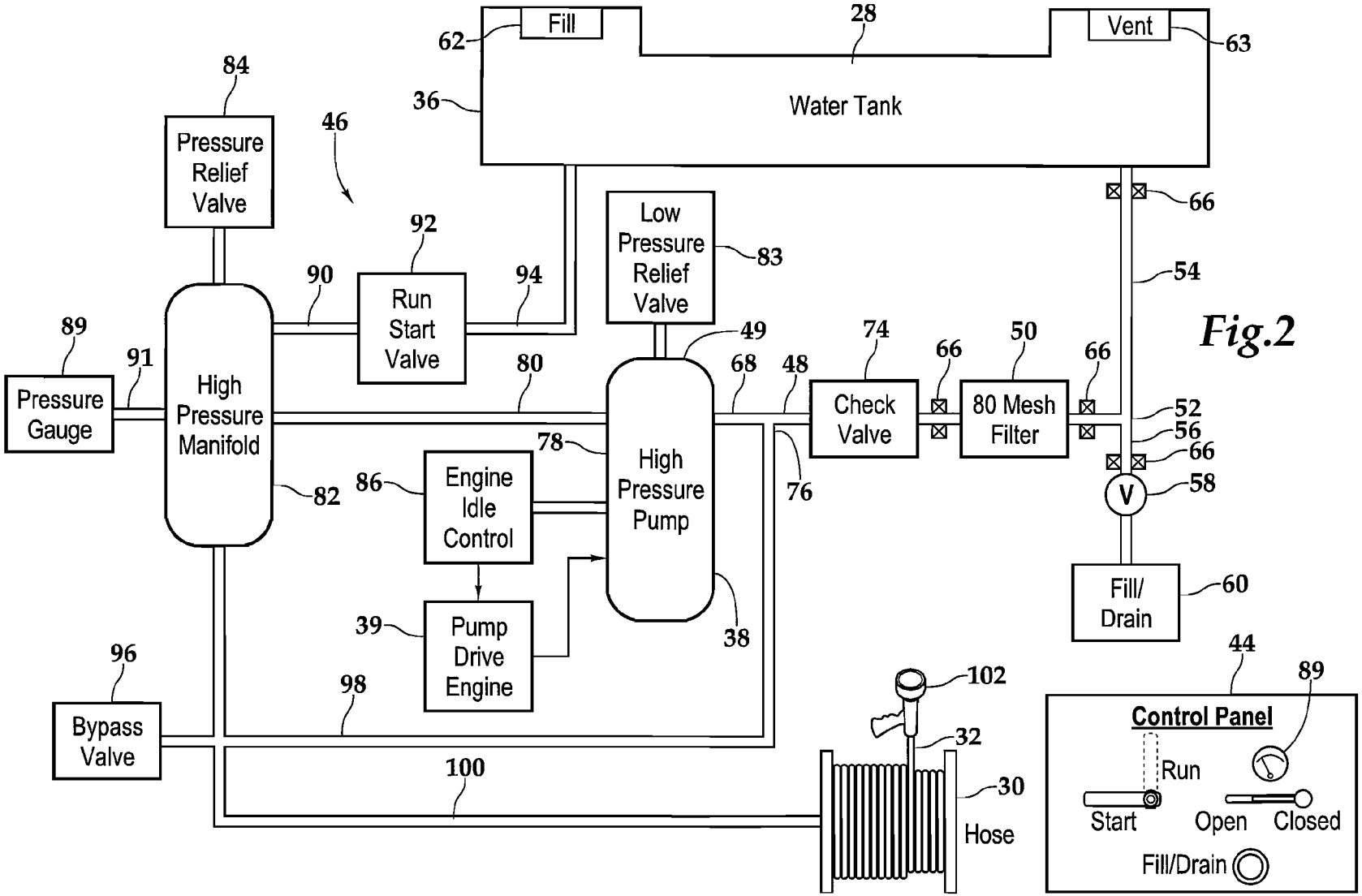
FIG. 2 is a schematic drawing of the components and their operational arrangement of the ultrahigh pressure firefighting skid unit of FIG. 1
Figure 3:
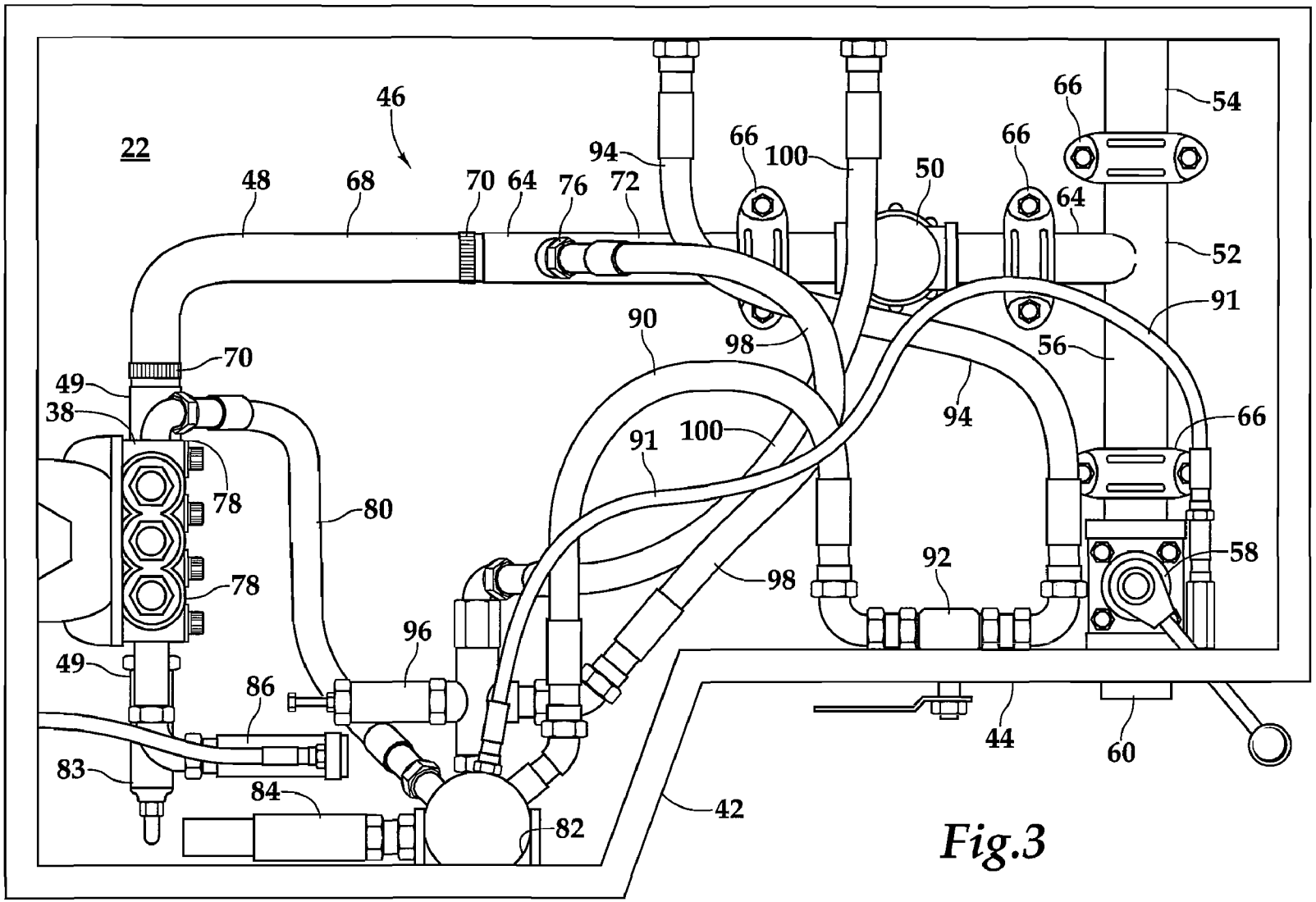
FIG. 3 is a pictorial view of the fluid control system of the ultrahigh pressure firefighting skid unit of FIG. 1.

Referring more particularly to FIGS. 1-3 wherein like numbers refer to similar parts, an all-terrain vehicle 20 is shown in FIG. 1. The all-terrain vehicle 20 may be a modified stock item such as a Ranger 4×6 700 cc chassis. The all-terrain vehicle 20 has a skid platform 22 which extends behind the driver's cab 24 and over the rear wheels 25. The skid platform 22 is elevated with respect to a standard bed and employs a suitable suspension matched to the load. Mounted to the skid platform 22 is an ultrahigh pressure firefighting skid unit 26.

The ultrahigh pressure firefighting skid unit 26 comprises a 70 gallon water tank 28 formed of heavy gauge (¾ inch) welded polyethylene, which supports the hose reel 30. The water tank 28 incorporates a fill port 62 and a vent 63 and to minimize slosh moments which are created by acceleration-induced waves in the water tank a plurality of vertical anti-slosh baffles divide the larger water tank into connected but dynamically separate smaller tanks. The tank 28 is U-shaped i.e., has a base region which extends to a first height, and two wing regions which extend above the first height, and the tank extends across the width of the skid platform 22. A high-pressure hose reel 30 containing 150 feet of lightweight high-pressure hose 32 is mounted in the U of the water tank helping to move the CG of the skid unit towards the forward end 34 of the vehicle 20. The water tank 28 incorporates a translucent panel 36 which allows assessment of the amount of water in the tank. Mounted behind the tank 28 in the left quadrant of the skid platform 22 is a high-pressure water pump 38 with an output of 0.25 to 22 gallons per minute at 850 to 1,200 psi. The high-pressure water pump 38 can be procured from Cat Pumps and is driven by an engine 39 through a timing belt.

A sheet metal enclosure 40 encloses the water pump 38, and is mounted with vibration snubber or shock mounts to the skid platform 22. The metal enclosure 40 provides shock mounting to the pump drive engine 39 such as a 24 hp Honda GX 670. Adjacent to the sheet metal enclosure 40 is a hydraulic system enclosure 42, and control panel 44. Within the enclosure 42 are the components making up a hydraulic control system 46. Reference is made to FIG. 3 which shows the actual layout of the hydraulic control system 46, and to FIG.

2 which shows a general schematic of the same system. Starting with the high-pressure pump 38, a low-pressure pipe 48 connects the pump low-pressure side 49 to an 80 mesh prefilter 50 and then to a T-connection 52, one leg 54 of the T connects to the water tank 28, while the other leg 56 connects to a ball valve 58 which connects to a 1½ inch fire hose coupling 60. In the typical mode of operation the ball valve 58 is closed and water is drawn from the tank 28. The tank 28, as shown in FIG. 1, can be filled through a fill port 62 located on top of the tank, and can more rapidly and conveniently be filled through the fire hose coupling 60 when the ball valve 58 is open. The low pressure water pipe 48 is comprised of a number of stainless steel sections 64 connected by compressive pipe fixtures 66 such as those known by the trade name Gruvlock® and the rubber hose section 68 is connected by hose clamps 70 to the last stainless steel section 72, the rubber hose section serving to isolate the rigid stainless steel sections 64 from the pump 38 vibrations. The last stainless steel section 72 extends between the prefilter 50 and the rubber hose section 68 and contains a check valve 74 which allows water flow only towards the high-pressure pump 38 low-pressure side 49. The last stainless steel section 72 following the check valve 74 towards the low-pressure side of the pump 38 has a high-pressure water bypass inlet 76. Connected to the low-pressure side 49 of the pump 38 is a pressure relief valve 83.

The pump 38 has a high-pressure side 78 which supplies high-pressure water between the about 850-1,250 psi through the first high-pressure hose 80 to a cylindrical high-pressure manifold 82. Connected to the high-pressure side 78 of the pump 38 is an engine idle control valve 86. The engine idle control valve 86 is set at about 1,500 psi and sets the engine 39 to idle when pump output pressure exceeds 1500 psi. The high-pressure manifold 82 is connected to a high-pressure relief valve 84 set to about 1750 psi, and to a pressure gage 89 by a pressure hose 91. The high-pressure manifold 82 is connected by a second high-pressure hose 90 to a start/run ball valve 92 which is connected by a third high-pressure hose 94 to the water tank 28. Also connected to the high-pressure manifold 82 is a pressure unloader valve 96 which is set to 1,600 psi. When the valve is closed water flows through a fourth high-pressure hose 100 which connects to plumbing leading to a high-pressure hose reel 30 and a high-pressure hose 32. When the unloader valve 96 is open the high-pressure manifold 82 is connected to a recirculation pressure hose 98 which connects to the high-pressure water bypass inlet 76.

To operate the ultrahigh pressure firefighting skid unit 26 the high-pressure fog nozzle 102 which terminates the high-pressure hose 32 is closed, and the desired amount of hose 32 is unwound. The run/start valve 92 is set in the open or start position as shown in FIGS. 2 and 3 and the engine 39 is started and after a few seconds the run/start valve 92 is moved to the closed/run position, and pressure builds up in the high-pressure manifold 82 until the unloader valve 96 opens allowing flow to the recirculation high-pressure hose 98 to the high-pressure bypass inlet 76. At the same time the engine idle control valve 86 puts the engine 39 into idle. When the high-pressure fog nozzle 102 is opened pressure drops and the unloader valve 96 closes, and the engine idle control valve 86 also closes, bringing the engine up to operational rpm and high pressure water is supplied to the nozzle 102.

The arrangement of the hydraulic control system 46 as shown in FIG. 3 is arranged for ease of maintenance. All the high-pressure hoses 80, 90, 94, 98, 100, except the pressure hose 91 which goes to the pressure gage 89, are of the same length and interchangeable, so only a single spare is required. The remaining plumbing elements, 48, 72, 50, 52 are all readily disconnected by hose clamps 70 or by compression locks 66. The stainless steel sections 64 are supported by brackets (not shown) to the skid platform 22 and the remaining hoses are supported at their ends to the components to which they attach. The pressure relief valves 83, 84 vent through the skid platform 22.

The skid unit 26 includes its own battery 104 which provides the electric start for the engine 39 and is also used to drive on electric rewind (not shown) on the high-pressure hose reel 30. The high-pressure hose 32 is guided between rollers 106 and captains 108 mounted to the hose reel 30, and a roller 110 and captains 112 mounted on the cover 114 of the hydraulic enclosure 42.

The Ranger 4×6 700 cc all-terrain vehicle 20 has a dry weight of about 1,185 lbs, but it is built to carry 1,000 lbs in the bed or skid platform 22. The ultrahigh pressure firefighting skid unit 26 weighs about 875 lb with a full water load of about 70 gals.

It should be understood that the skid unit can be mounted to a variety of small lightweight all-terrain vehicles, for example a Ranger 4×4 which may have wheel replacement tracks such as those disclosed in D505,136 and sold under the Mattracks trademark.

It is understood that the invention is not limited to the particular construction and arrangement of parts herein illustrated and described, but embraces all such modified forms thereof as come within the scope of the following claims.

I claim:

1. An ultrahigh pressure firefighting skid unit for mounting to an all-terrain vehicle comprising:

a skid platform;

a U-shaped water tank having portions forming an upwardly opening central U, the water tank mounted on a portion of the skid platform closest to a forward end;

a reel and a high-pressure hose wound thereon, the hose terminating in a high-pressure fog nozzle, the reel mounted to the water tank in the upwardly opening central U;

a high-pressure water pump forming a source of 800 to 1,500 psi water mounted to the skid platform behind the U-shaped water tank;

an internal combustion engine mounted in driving relation to the high-pressure water pump;

wherein the high-pressure water pump has a low-pressure side connected to the water tank through a check valve;

wherein the high-pressure water pump has a high-pressure side;

a high-pressure manifold connected to the high-pressure side of the high-pressure water pump;

a pressure unloader valve connected in high-pressure water receiving relation to the high-pressure manifold and connected in high-pressure water supplying relation to a first pressure hose which is in supplying relation to the reel and the high-pressure hose terminating in the high-pressure fog nozzle, and the unloader valve is also connected in high-pressure water supplying relation to a second hose which connects to the high-pressure water pump to effect recirculation, the pressure unloader valve having a valve setpoint such that the unloader valve switches from the first high-pressure hose to the second high-pressure hose when the unloader valve is subject to a pressure higher than the setpoint; and an engine idle control valve mounted to the high-pressure side of the high-pressure water pump, and idle controlling operatively connected to the internal combustion engine, the idle control valve having a setpoint such that the idle control valve operates when the pressure unloader valve operates.

2. An all-terrain vehicle and ultrahigh pressure firefighting skid unit mounted thereto comprising:

an all-terrain vehicle having a forward end, an driver's cab and a skid platform positioned behind the driver's cab;

a U-shaped water tank having portions forming an upwardly opening central U, the water tank mounted on a portion of the skid platform closest to the forward end, and behind the driver's cab;

a reel and a high-pressure hose wound thereon, the hose terminating in a high-pressure fog nozzle, the reel mounted to the water tank in the upwardly opening central U;

a high-pressure water pump forming a source of 800 to 1,500 psi water mounted to the skid platform behind the U-shaped water tank;

an internal combustion engine mounted in driving relation to the high-pressure water pump;

wherein the high-pressure water pump has a low-pressure side connected to the water tank through a check valve;

wherein the high-pressure water pump has a high-pressure side;

a high-pressure manifold connected to the high-pressure side of the high-pressure water pump;

a pressure unloader valve connected in high-pressure water receiving relation to the high-pressure manifold and connected in high-pressure water supplying relation to a first pressure hose which is in supplying relation to the reel and the high-pressure hose terminating in the high-pressure fog nozzle, and the unloader valve is also connected in high-pressure water supplying relation to a second hose which connects to the high-pressure water pump to affect recirculation, the pressure unloader valve having a valve setpoint such that the unloader valve switches from the first high-pressure hose to the second high-pressure hose when the unloader valve is subject to a pressure higher than the setpoint;

an engine idle control valve mounted to the high-pressure side of the high-pressure water pump, and idle controlling operatively connected to the internal combustion engine, the idle control valve having a setpoint such that the idle control valve operates when the pressure unloader valve operates;

a run/start valve connected between the high-pressure manifold and the water tank to close or open a connection between the high-pressure manifold and the water tank; and wherein the second hose is connected to the water supply pipe between the high-pressure pump and the check valve.

3. An all-terrain vehicle and ultrahigh pressure firefighting skid unit mounted thereto comprising:

an all-terrain vehicle having a forward end, an driver's cab and a skid platform positioned behind the driver's cab;

a U-shaped water tank having portions forming an upwardly opening central U, the water tank mounted on a portion of the skid platform closest to the forward end, and behind the driver's cab;

a reel and a high-pressure hose wound thereon, the hose terminating in a high-pressure fog nozzle, the reel mounted to the water tank in the upwardly opening central U;

a high-pressure water pump forming a source of 800 to 1,500 psi water mounted to the skid platform behind the U-shaped water tank;

an internal combustion engine mounted in driving relation to the high-pressure water pump;

wherein the high-pressure water pump has a high-pressure side;

a high-pressure manifold connected to the high-pressure side of the high-pressure water pump;

a pressure unloader valve connected in high-pressure water receiving relation to the high-pressure manifold and connected in high-pressure water supplying relation to a first pressure hose which is in supplying relation to the reel and the high-pressure hose terminating in the high-pressure fog nozzle, and the unloader valve is also connected in high-pressure water supplying relation to a second hose which connects to the high-pressure water pump to affect recirculation, the pressure unloader valve having a valve setpoint such that the unloader valve switches from the first high-pressure hose to the second high-pressure hose when the unloader valve is subject to a pressure higher than the setpoint;

an engine idle control valve mounted to the high-pressure side of the high-pressure water pump, and idle controlling operatively connected to the internal combustion engine, the idle control valve having a setpoint such that the idle control valve operates when the pressure unloader valve operates;

a run/start valve connected between the high-pressure manifold and the water tank to close or open a connection between the high-pressure manifold and the water tank;

a water supply pipe connected between the water tank and the high-pressure pump in water supplying relation to the high-pressure pump;

a check valve arranged in the water supply pipe to allow water flow only towards the high-pressure pump;

wherein the second hose is connected to the water supply pipe between the high-pressure pump and the check valve; and a prefilter arranged in the water supply pipe between the water tank and the check valve.

* * * * *